US005228882A

United States Patent [19]

Kraemer

[11] Patent Number: 5,228,882

[45] Date of Patent: Jul. 20, 1993

[54] LOCKING CHIMNEY CAP

[75] Inventor: George L. Kraemer, Ontario, Canada

[73] Assignee: Hy-C Company, Inc., St. Louis, Mo.

[21] Appl. No.: 529,983

[22] Filed: May 19, 1990

[51] Int. Cl.[5] ..... F23J 13/00

[52] U.S. Cl. ..... 454/4; 454/14; 24/495

[58] Field of Search ..... 98/67, 42.12, 59, 122; 137/533.17; 248/412, 231.3; 24/495, 496, 510, 134 P

[56] References Cited

U.S. PATENT DOCUMENTS

| | | | |
|---|---|---|---|
| 101,062 | 3/1870 | Thompson | 24/134 P |
| 580,588 | 4/1887 | Waters | 98/122 |
| 621,475 | 3/1899 | McCormick | 24/134 P |
| 878,811 | 2/1908 | Lincoln | 98/67 |
| 1,197,803 | 9/1916 | Dierks | 98/122 |
| 1,305,353 | 6/1919 | Gipson | 24/134 P |
| 1,520,716 | 12/1924 | Judd | 24/134 P |
| 4,549,473 | 10/1985 | Alexander et al. | 98/67 |
| 4,697,500 | 10/1987 | Hisey | 98/67 |
| 4,716,811 | 1/1988 | Johnson | 24/495 |

*Primary Examiner*—Albert J. Makay
*Assistant Examiner*—William C. Doerrler
*Attorney, Agent, or Firm*—Paul M. Denk

[57] ABSTRACT

A chimney cap for installation on a chimney, comprising a lid assembly, a bracket for supporting the lid assembly, and revolving clamps pivotally connected to the bracket for releasable attachment to various dimensions of chimney flue tiles. The clamps are pivotable for rotation between a first position for accommodating a first dimension of chimney flue tiles and a second position for accommodating a second dimension of chimney flue tiles, the second dimension being larger than the first dimension. The clamps each comprise at least two oppositely disposed spring loaded cam action toggles for gripping opposite sides of the chimney flue tiles irrespective of the thickness of the tiles.

6 Claims, 3 Drawing Sheets

FIG. 4
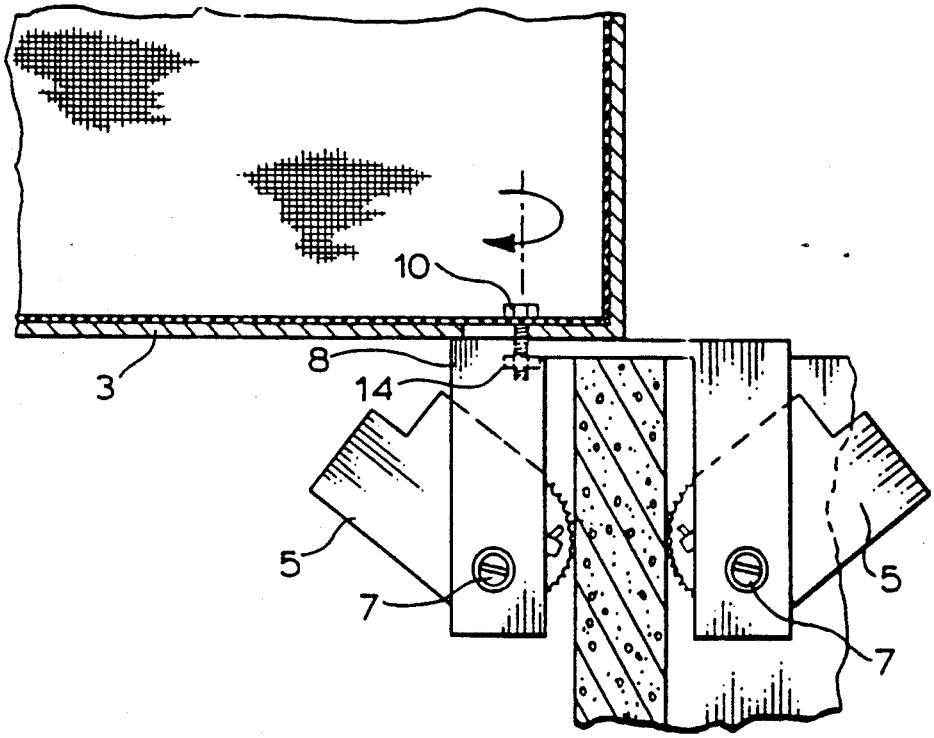
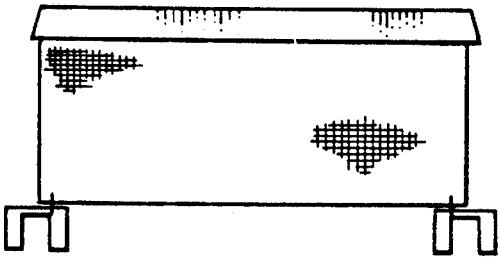
FIG.5A
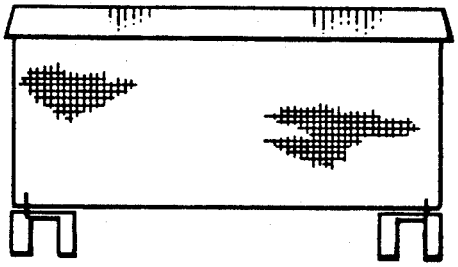
FIG. 5B
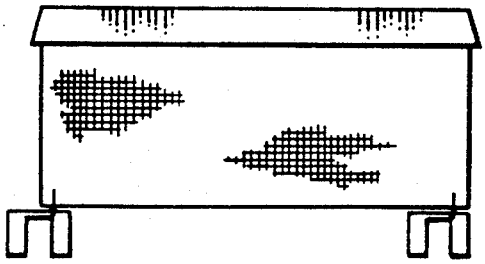
FIG. 5C

LOCKING CHIMNEY CAP

BACKGROUND OF THE INVENTION

1. Field of Invention

This invention relates in general to chimney caps, and more particularly to a locking chimney cap for use with clay flue tiles or the like.

2. Discussion of the Prior Art

Chimney caps are commonly used on chimneys to prevent the ingress of rain, snow, birds, rodents and leaves as well as to prevent down-drafts and to reduce the deterioration of mortar in the chimney.

Most clay flue tiles in masonry chimneys are either 200×200 mm, 200×300 mm, or 300×300 mm outside diameter. It is thus readily seen that either the 200 mm or 300 mm dimension exists on most flue tiles. However, each size of flue tile typically also has a different wall thickness dimension. For example, a 200×200 mm flue tile is usually 16 mm thick with a tolerance of 3 mm; a 200×300 mm flue tile is typically 19 mm thick with a tolerance of 3 mm; while a 300×300 mm flue tile is usually 23 mm thick with a tolerance of 3 mm. Furthermore, the outside diameter of the tiles themselves are typically characterized by tolerances of from 0 to 10 mm. These tolerances are normally very difficult to maintain due to different styles and ages of chimneys.

The cumulative effect of the varying wall thicknesses and tolerances is that it is typically very difficult to fit all flue sizes with a chimney cap unless an almost infinitely adjustable mechanical fixing technique is employed.

In most instances, in order to determine the size of chimney cap required for a particular chimney, it is necessary for a person to climb onto the roof and measure the flue size to determine whether or not the chimney conforms to one of the aforementioned standard sizes.

Upon determining the dimensions of the chimney flue tile, the installer then must descend from the roof, purchase an appropriate size of chimney cap, and then climb again onto the roof for installation of the chimney cap.

Some prior art chimney caps require the use of a variety of tools for installation. For example, various prior art arrangements utilize mechanical attachment components such as thumb screws or clamp arrangements.

U.S. Pat. No. 4,697,500 (Hisey) discloses a well known prior art clamp and bracketing chimney cap arrangement utilizing nuts and bolts for fixing the chimney cap to the flue tiles. The Hisey patent suffers from the disadvantage that the various nuts and bolts may become loose resulting in possible dislodgement of the chimney cap.

U.S. Pat. No. 4,482,267 (Widerby) discloses a spring loaded apparatus for mounting a ventilation element in a conduit. No size adjustment is provided in the Widerby patent. Instead, one or several anchor devices are provided on an internal annular ridge, which bear against the inside walls of the conduit.

U.S. Pat. Nos. 2,976,796 (Anthony et al) and 2,805,616 (Roth) disclose additional well known prior art chimney caps for installation into a chimney of standard size. There is no provision in either of the Anthony et al or Roth patents for adapting the chimney cap to flues of different size.

Thus, according to the above-discussed prior art chimney caps, it is typically necessary for the person installing the chimney cap to make at least two or more climbings of the roof with tools in order to install the chimney cap. Multiple climbings of the roof with tools is both tiring and potentially dangerous for the average home owner, particularly in view of the danger of accidentally falling off the roof with each ascent or descent.

Additional prior art chimney caps have been developed for accommodating different sizes of chimney flue tiles, thereby overcoming the prior art disadvantage of requiring two or more climbings onto the roof.

U.S. Pat. No. 841,660 (Barnes) teaches an adjustable locking mechanism consisting of a pair of arms which engage the interior walls of the chimney at the corners thereof, the arms being provided with laterally extending spurs adapted to be driven or otherwise embedded in the mortar. The arms are provided with lateral extensions, the adjacent longitudinal edges of which are provided with teeth or serrations adapted to inter-engage, and thereby lock the arms in an adjusted position. One of the arms is provided with an offset portion to permits sliding movement of the extension of the adjacent arm.

Extending vertically through a lateral ear or lug portion of the supporting bar in Barnes is a pin on which is pivotally mounted a locking member or cam, adapted to engage the smooth edge of the adjacent extension, thereby forcing the teeth into engagement with each other, and thus locking the arms into an adjusted position.

U.S. Pat. No. 4,335,648 (Mitchell) discloses a chimney cap or cowl which is secured by a wing nut. The chimney cowl of Mitchell is self-adjusting to the dimensions of flue tile. However, the installation technique of the wing nut arrangement of Mitchell is fairly complex.

A fundamental disadvantage of such prior art adjustable size chimney caps is that the various locking mechanisms deployed therein are subject to loosening. In particular, since chimney caps are often subjected to strong external forces due to high wind conditions, etc., these prior art chimney caps are prone to accidental dislodgement often resulting in damage to the chimney cap in the event that it falls off the roof.

Moreover, the prior art mechanical screw and nut type of locking mechanisms are subject to corrosion or fouling, making them difficult to remove for chimney cleaning.

SUMMARY OF THE INVENTION

According to one aspect of the present invention, there is provided a chimney cap incorporating clamping apparatus for releasable attachment to chimney flue tiles of various dimensions. In particular, the clamping apparatus is pivotable for rotation between a first position and a second position and also slides laterally for accommodating virtually any dimension of chimney flue tile.

According to a preferred embodiment, the clamping apparatus comprises spring loaded cams or toggles which bite securely into both sides of the flue tile to provide a permanent fixing to the tile. One advantage of the chimney cap according to the present invention over that described in the aforenoted prior art patents, is the self-adjusting nature of the teeth which, due to the spring loaded cam action of the toggle, results in a gripping force into the flue tiles which is proportional to the external force (e.g. wind) tending to pull the chimney cap from the flue tile.

This feature is nowhere taught or suggested by the above-described prior art patents.

Thus, in accordance with an aspect of the present invention in its most general form, there is provided a chimney cap for installation on a chimney, comprising a lid assembly; bracket means for supporting said lid assembly; and clamp means pivotally connected to said bracket means for releasable attachment to chimney flue tiles of said chimney; said clamp means being pivotable for rotation between a first position for accommodating a first dimension of said chimney flue tiles, and a second position for accommodating a second dimension of said chimney flue tiles, said second dimension being larger than said first dimension.

INTRODUCTION TO THE DRAWINGS

A preferred embodiment of the present invention will be described in detail below with reference to the following drawings, in which:

FIG. 4 is a cross section detail view of the clamp assembly rotated to an outside position; and FIG. 5A-5C are side elevation views of the chimney cap assembly adjusted for 300 mm, 200 mm and 250 mm flue tiles, respectively.

Figure 1:
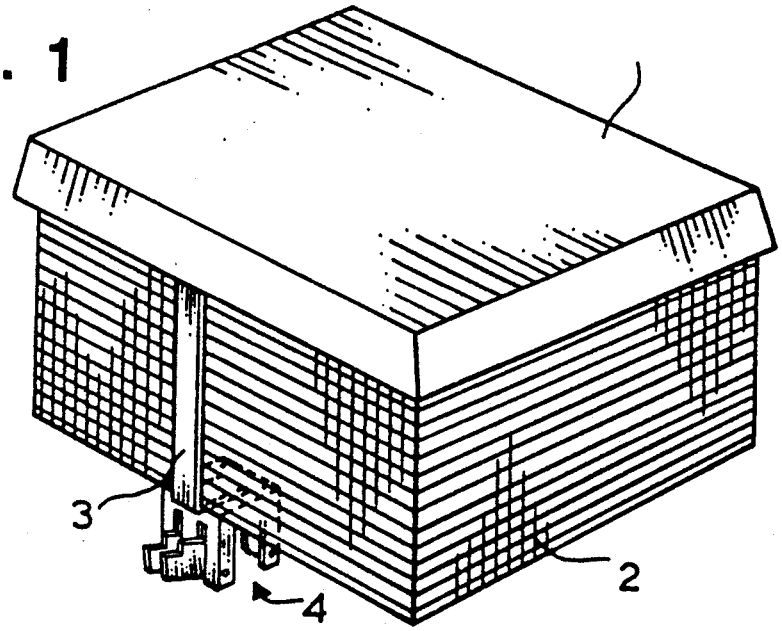
FIG. 1 is a perspective view of a chimney cap assembly in accordance with the present invention.

With reference to FIG. 1, reference numeral 1 refers to the lid of a chimney cap assembly, 2 refers to the mesh screen used to prevent objects from entering the chimney, 3 refers to the assembly bracket, and 4 refers to the clamp assembly. Although not shown in FIG. 1, a similar clamp assembly is typically connected to the chimney cap on the opposite side from the illustrated clamp assembly 4, as discussed in detail below with reference to FIGS. 5A-5C.

The lid assembly 1 is supported by the assembly bracket 3, while the wire mesh 2 extends around the periphery of the chimney cap and is carried by the assembly bracket 3.

As discussed in greater detail below, the clamp assembly 4 is pivotable around an axis co-extensive with the assembly bracket 3.

Figure 2:
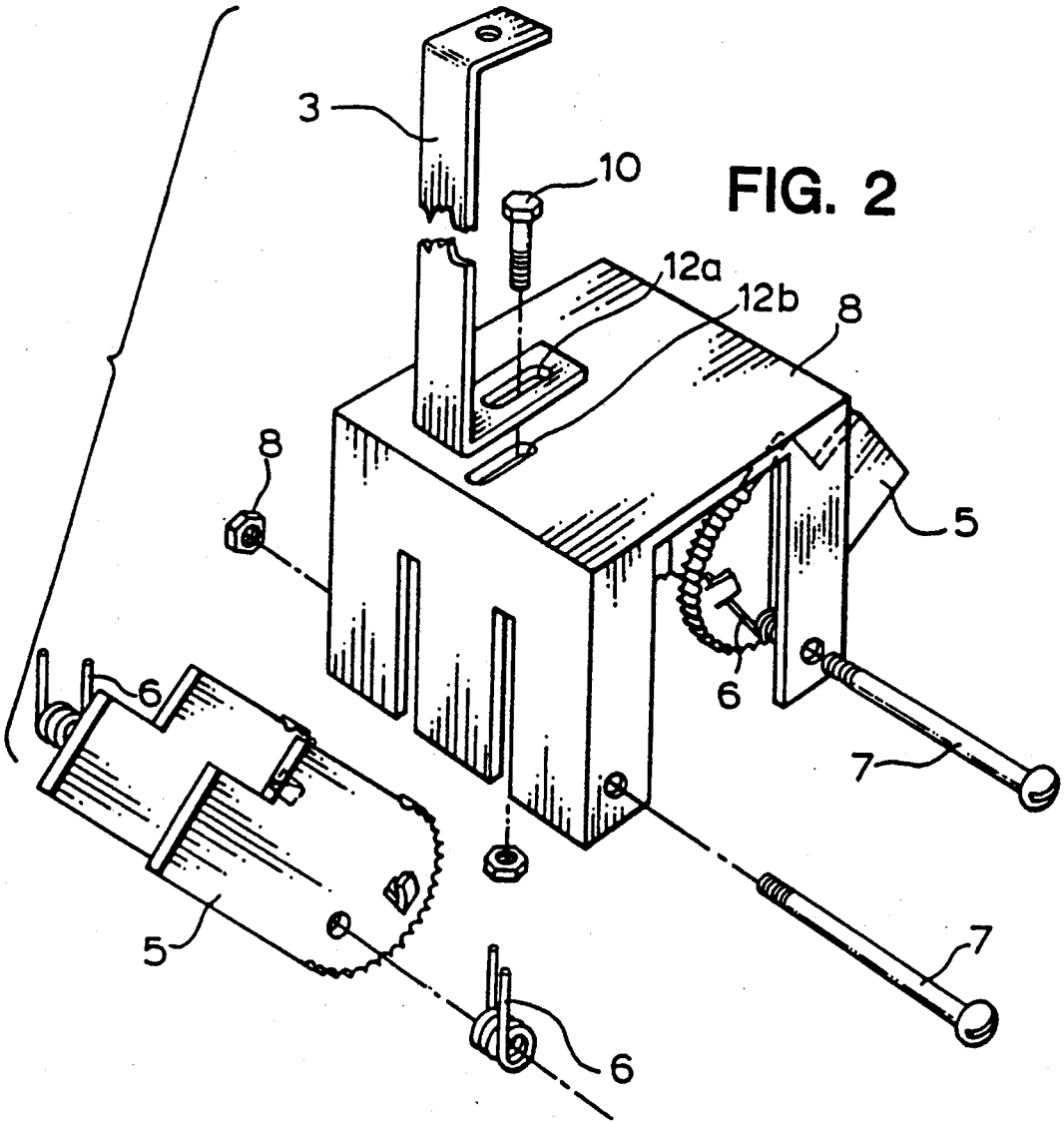
FIG. 2 is an exploded view of the clamp assembly of FIG. 1.

Turning to FIG. 2, the clamp assembly 4 is shown in greater detail comprising an assembly housing 8, cam action toggles 5 with protruding teeth, torsion springs 6 tending to close and reduce the space between opposing toggles, bolts 7 and nuts 8*a* similar fixing elements for holding the toggles and springs in place, and a further bolt 10 extending through slots 12A and 12B in the bracket 3 and housing 8, respectively. The bolt 10 (or other suitable fastener) is secured via an additional nut 14 (FIGS. 3A, 3B and 4).

In operation, the chimney cap of the present invention is installed by rotating and/or sliding the two oppositely disposed clamped assemblies 4 around their respective axes defined by bolt 10 on each, for adjusting to accommodate flue sizes of 200 mm (i.e. the inner position shown in FIG. 5B, 300 mm (i.e. the outer position shown in FIG. 5A), or in between as shown in FIG. 5C. In this way, all basic as well as non standard flue tile sizes can be fitted. The chimney cap clamps are positioned with the opposing toggles 5 on each clamp at the edges of the flue tile, and manually depressed until the housing 8 meets the top the flue tile.

Figure 3A:
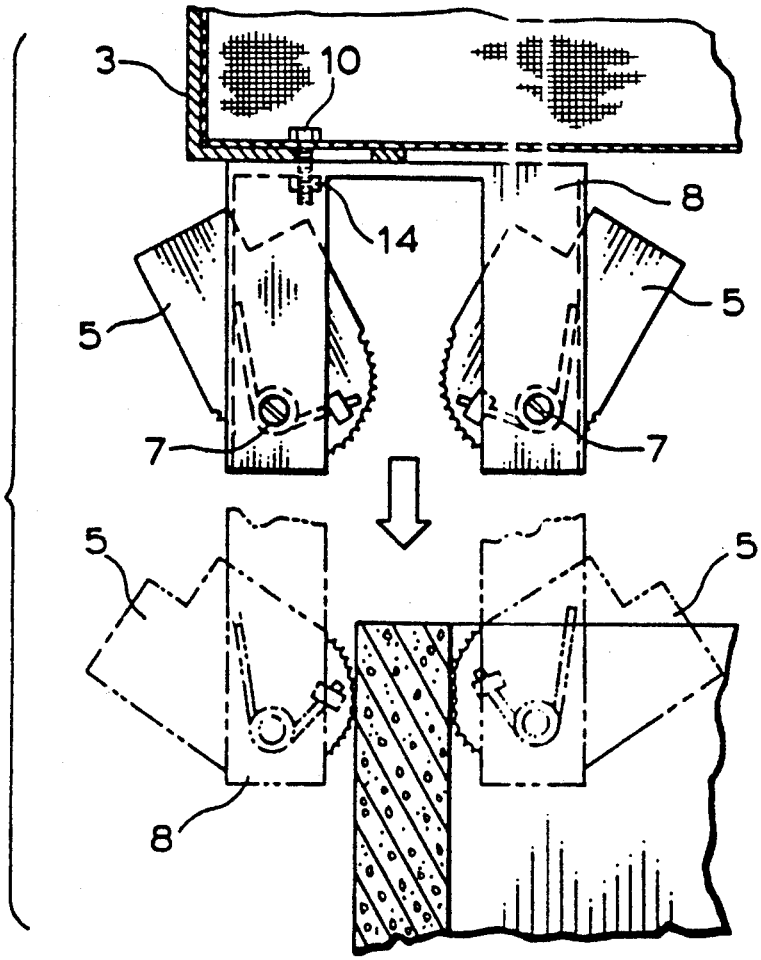
FIG. 3A is a cross section detail view of the clamp assembly rotated to an inside position.

Upon releasing the toggles 5, the teeth on the spring loaded toggles bite securely into both sides of the flue tile to provide a permanent fixing to the tile, as shown in FIG. 3A. In this way, the teeth are always self-adjusting to any thickness of flue tile. Moreover, due to the cam action positioning of the bolts 7, the teeth are caused to bite into the flue tile with increasing force in proportion to increasing external vertical, horizontal or diagonal forces applied to the chimney cap due to high winds, etc.

Figure 3B:
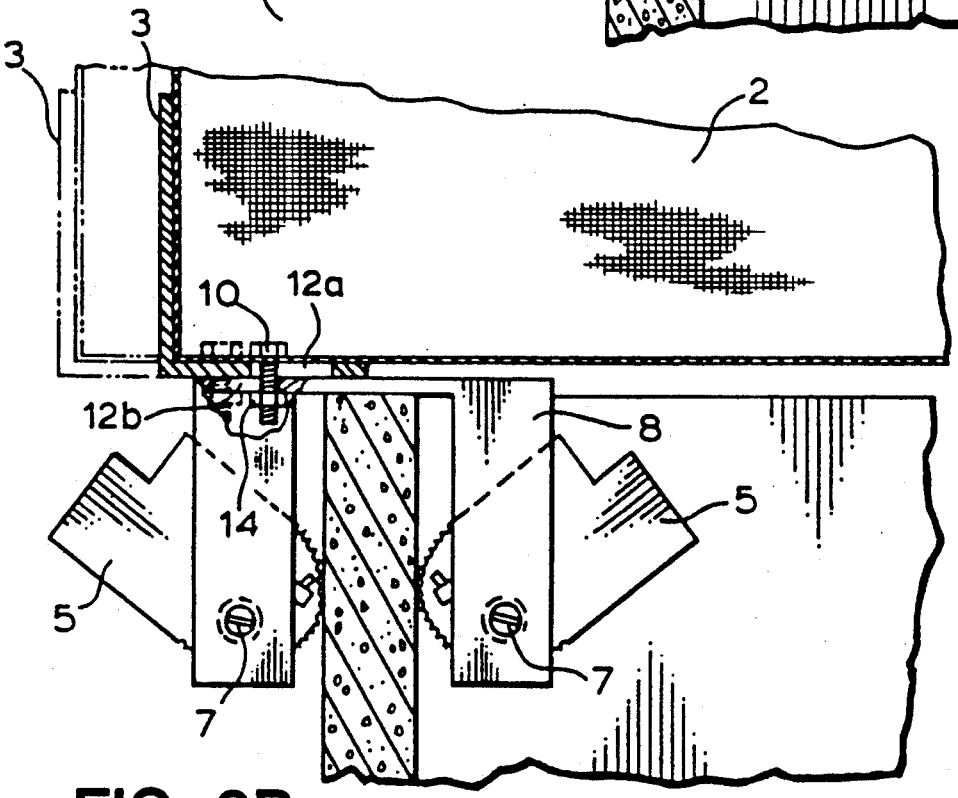
FIG. 3B is a cross section detail view of the clamp assembly adjusted for a larger diameter flue tile than that shown in FIG. 3A.

Additional small adjustments to accommodate the flue diameter may be effected by loosening the nut 14 and sliding the assembly 4 via slots 12A and 12B relative to the bracket 3, as shown in FIG. 3B. Alternatively, the nut 14 and bolt 10 may be replaced by an appropriately sized washer and rivet.

In order to remove the chimney cap for chimney cleaning or any other purpose, the cam action toggles 5 are simply depressed until the pressure is released from the opposing toggles and the chimney cap can be lifted from the flue tile.

In summary, according to the present invention, a chimney cap is provided which is adjustable to fit virtually any dimension and wall thickness of flue tile. Moreover, the spring loaded cam action mechanism of the present invention results in a biting or gripping force into the flue tiles which increases in proportion to external forces applied to the chimney cap (e.g. wind, tree branches, etc.).

Other embodiments or variations of the present invention are possible. For example, while the preferred embodiment (FIG. 1) shows a single clamp assembly 4 connected to the chimney cap, two or up to four such clamps may be advantageously used on respective sides of the chimney cap. Also, whereas each clamp assembly is shown comprising two pairs of opposing spring loaded cam toggles, a single pair of toggles or greater than two such cam action toggle pairs may be used. In addition, the lid assembly 1, bracket 3, and mesh 2 may be circular or any other convenient shape, such as the cowl shape of the prior art Mitchell patent.

All such modifications or alternatives are believed to be within the sphere and scope of the present invention as defined by the claims appended hereto.

I claim:

1. A chimney cap for installation on a chimney, comprising a lid assembly, bracket means for supporting said lid assembly, and clamp means pivotally connected to said bracket means for releasable attachment to a chimney flue tile of said chimney, said clamp means being pivotal for rotation between a first portion for accommodating a first dimension of a said chimney flue tile, and a second position for accommodating a second dimension of a chimney flue tile, said second dimension being larger than said first dimension, and said clamp means further comprising at least two oppositely disposed spring loaded cam action toggles for gripping opposite sides of a flue tile.

2. A chimney cap as defined in claim 1, further comprising a mesh screen carried by said bracket means, for preventing objects from entering said chimney.

3. A chimney cap as defined in claim 1, wherein said clamp means are adapted to rotate around respective axes offset from respective centers thereof.

4. A chimney cap as defined in claim 1, wherein said toggles further include respective tooth portions for biting securely into said opposite sides of said chimney flue tile.

5. A chimney cap as defined in claim 1, wherein said clamp means further comprises:

a) a housing assembly:

b) a fixing pin for pivotally connecting said housing assembly to said bracket means along a predetermined axis adjacent one side of said housing assembly;

c) at least one pair of cam action toggles;

d) at least one pair of bolts for pivotally connecting respective ones of said toggles to said housing assembly along respective axes orthogonal to said predetermined axis; and e) a pair of torsion springs connected to respective ones of said cam action toggles and said housing assembly, for urging said cam action toggles into gripping engagement with said chimney flue tiles.

6. A chimney cap as defined in claim 1, further comprising means for laterally adjusting relative positioning between said bracket means and said clamp means for accommodating dimensions of the chimney flue tiles intermediate said first and said second dimension.

* * * * *

UNITED STATES PATENT AND TRADEMARK OFFICE

CERTIFICATE OF CORRECTION

PATENT NO. : 5,228,882

DATED : July 20, 1993

INVENTOR(S) : George L. Kraemer

It is certified that error appears in the above-identified patent and that said Letters Patent is hereby corrected as shown below:

Claim 1, column 4, line 55, change "portion" to ---position---.

Signed and Sealed this

Fifth Day of April, 1994

Bruce Lehman

*Attest:*

BRUCE LEHMAN

*Attesting Officer*

*Commissioner of Patents and Trademarks*